US011043764B2

(12) United States Patent
Takane et al.

(10) Patent No.: US 11,043,764 B2
(45) Date of Patent: Jun. 22, 2021

(54) FLAT-CONDUCTOR CONNECTOR

(71) Applicant: IRISO ELECTRONICS CO., LTD., Kanagawa (JP)

(72) Inventors: Tom Takane, Kanagawa (JP); Jun Oguro, Kanagawa (JP)

(73) Assignee: IRISO ELECTRONICS CO., LTD., Kanagawa (JP)

( * ) Notice: Subject to any disclaimer, the term of this patent is extended or adjusted under 35 U.S.C. 154(b) by 0 days.

(21) Appl. No.: 16/649,163

(22) PCT Filed: Sep. 13, 2018

(86) PCT No.: PCT/JP2018/033990
§ 371 (c)(1),
(2) Date: Mar. 20, 2020

(87) PCT Pub. No.: WO2019/069653
PCT Pub. Date: Apr. 11, 2019

(65) Prior Publication Data

US 2020/0251842 A1 Aug. 6, 2020

(30) Foreign Application Priority Data

Oct. 5, 2017 (JP) ..... JP2017-194860

(51) Int. Cl.
*H01R 12/79* (2011.01)
*H01R 12/77* (2011.01)
*H01R 12/88* (2011.01)

(52) U.S. Cl.
CPC ..... *H01R 12/79* (2013.01); *H01R 12/774* (2013.01); *H01R 12/88* (2013.01)

(58) Field of Classification Search
CPC ..... H01R 12/79; H01R 12/774; H01R 12/88
See application file for complete search history.

(56) References Cited

U.S. PATENT DOCUMENTS 10,566,721 B2 * 2/2020 Nakajima ..... H01R 12/79
2006/0178039 A1 8/2006 Chen
(Continued)

FOREIGN PATENT DOCUMENTS

JP 2011-040295 A 2/2011
JP 2013-196784 A 9/2013
(Continued)

OTHER PUBLICATIONS

International Search Report for PCT Patent App. No. PCT/JP2018/033990 (dated Dec. 11, 2018).

*Primary Examiner* — Tho D Ta
(74) *Attorney, Agent, or Firm* — Cermak Nakajima & McGowan LLP; Tomoko Nakajima

(57) ABSTRACT

In a flat-conductor connector having an automatic lock mechanism for a flat conductor, a fitting connection operation of a flat conductor is enabled to be reliably performed again after the flat conductor is extracted. A flat-conductor connector 1 includes a lock member including a slip-off stop locking surface configured to pass through a flat conductor housed in a housing chamber of a housing in the thickness direction of the flat conductor and lock the flat conductor. The lock member includes a supporting portion configured to support the slip-off stop locking surface so as to be displaceable between a locking position at which the lock member is locked with and stops the flat conductor from slipping off and a lock cancellation position at which the lock member is unlocked from the flat conductor to cause the flat conductor to be extractable from the housing chamber.

8 Claims, 13 Drawing Sheets

(56) References Cited

U.S. PATENT DOCUMENTS

| | | | | |
|---|---|---|---|---|
| 2012/0289093 | A1* | 11/2012 | Ogura | H01R 12/88 439/629 |
| 2013/0280947 | A1 | 10/2013 | Matoba et al. | |
| 2016/0268717 | A1* | 9/2016 | Tamaki | H01R 13/639 |
| 2017/0170587 | A1 | 6/2017 | Takane | |
| 2019/0044263 | A1* | 2/2019 | Manba | H01R 12/88 |

FOREIGN PATENT DOCUMENTS

| | | | |
|---|---|---|---|
| JP | 2015-043299 | A | 3/2015 |
| JP | 2016-0171029 | A | 9/2016 |
| JP | 2017-107711 | A | 6/2017 |

* cited by examiner

FLAT-CONDUCTOR CONNECTOR

This application is a national phase entry under 35 U.S.C. § 371 of PCT Patent Application No. PCT/JP2018/033990, filed on Oct. 5, 2017, which claims priority under 35 U.S.C. § 119 to Japanese Patent Application No. 2017-194860, filed Oct. 5, 2017, both of which are incorporated by reference.

TECHNICAL FIELD

The present invention relates to a flat-conductor connector configured to conductively connect a flat conductor, such as FFC (flexible flat cable) or FPC (flexible printed circuits), and a substrate circuit to each other.

BACKGROUND ART

As a flat-conductor connector, there is a known connector having an automatic lock mechanism configured to be caused by only an operation of inserting a flat conductor into a housing chamber of a housing to be fitting-connected with and stop the flat conductor from slipping off. The flat-conductor connector in PTL 1 is one example, and, according to this, it is possible to easily fitting-connect a flat conductor and stop the flat conductor from slipping off. To extract the fitting-connected flat conductor in the flat-conductor connector in PTL 1, a movable member (30) disposed at an upper surface of a housing (10) is rotated to an open position to thereby cause a locking portion (36) disposed at the movable member (30) to cancel locking with respect to the flat conductor, and thereafter, the flat conductor is extracted.

CITATION LIST

Patent Literature

PTL 1: Japanese Unexamined Patent Application Publication No. 2015-43299, FIG. 2, FIG. 5, and FIG. 6

SUMMARY OF INVENTION

Technical Problem

In the aforementioned flat-conductor connector in PTL 1, a plate spring-shaped engagement piece (41B) for holding the movable member (30) at the open position is formed at a portion of a metal shell (41). Consequently, an operator is not required to hold the movable member (30) at the open position when extracting the flat conductor, which provides an advantage that an operation of opening the movable member (30) and an operation of extracting the flat conductor can be performed by one hand. To insert the flat conductor again after extracting the flat conductor, however, an operation of closing the movable member (30) held in an open state to a close position is required, which is troublesome for an operator. In addition, if the movable member (30) is not correctly returned to the close position, the flat conductor is not possible, even when inserted, to be stopped from slipping off, and it is thus not possible to correctly fitting-connect the flat conductor to the flat-conductor connector.

The present invention is developed on the background of such an existing technology. An object of the present invention is to enable, in a flat-conductor connector including an automatic lock mechanism for a flat conductor, a fitting connection operation of a flat conductor after the flat conductor is extracted to be performed again reliably.

Solution to Problem

To achieve the aforementioned object, the present invention is configured to have the following features.

The present invention provides a flat-conductor connector including: a housing including a housing chamber into which and from which a flat conductor is insertable and extractable; and a lock member including a locking portion configured to pass through the flat conductor housed in the housing chamber in a thickness direction of the flat conductor and lock the flat conductor, wherein the lock member includes a supporting portion that supports the locking portion so as to be displaceable between a locking position and a lock cancellation position, the locking position being a position at which the lock member is locked with and stops the flat conductor from slipping off, the lock cancellation position being a position at which the lock member is unlocked from the flat conductor to cause the flat conductor to be extractable from the housing chamber, and wherein the flat-conductor connector includes an urging member including a spring piece that urges the supporting portion so as to displace the locking portion present at the lock cancellation position to the locking position.

According to the present invention, the lock member includes the supporting portion that supports the locking portion so as to be displaceable between the locking position at which the lock member is locked with and stops the flat conductor from slipping off and the lock cancellation position at which the lock member is unlocked from the flat conductor to cause the flat conductor to be extractable from the housing chamber. In addition, the flat-conductor connector according to the present invention includes the urging member including the spring piece that urges the supporting portion so as to cause the locking portion present at the lock cancellation position to be displaced to the locking position. Therefore, due to a structure in which the urging member urges the supporting portion, it is possible to cause an urging force of the spring piece of the urging member to act directly on the supporting portion. It is thus possible to reliably displace the locking portion via the supporting portion from the lock cancellation position to the locking position and possible to reliably maintain the locking position of the locking portion.

Specifically, during insertion of the flat conductor, the locking portion is displaced from the lock cancellation position to the locking position as a result of the urging member urging the supporting portion to cause the locking portion to be automatically locked with respect to the flat conductor, and, consequently, the flat conductor can be stopped from slipping off. In the fitting-connected state after the insertion of the flat conductor, the urging member holds the locking portion at the locking position at which the locking portion is locked with the flat conductor. Therefore, unless an operation of displacing the locking portion to the lock cancellation position against the urging force of the urging member is performed, the locking position of the locking portion is maintained, and conductive connection between the flat-conductor connector and the flat conductor can be reliably maintained. Moreover, after the flat conductor is extracted from the flat-conductor connector by operating the lock member to displace the locking portion to the lock cancellation position, the urging member urges the supporting portion, and the locking portion is thus automatically returned to the initial locking position without any operation performed with respect to the lock member. The urging member can be integrally provided as a portion of a resin molded body constituting the housing. Alternatively, the urging member can be provided as a metal component or a hard resin component that is a body differing from the housing.

The supporting portion according to the present invention can be configured to support the lock member at the housing so as to be rotatable between a close position of the lock member at which the locking portion is present at the locking position and an open position of the lock member at which the locking portion is present at the lock cancellation position.

According to the present invention, the supporting portion supports the lock member at the housing so as to be rotatable and displaceable between the open position and the close position of the lock member, and it is thus possible to integrate, in the supporting portion, a function of receiving urging of the urging member and a function of rotatably supporting the lock member. Consequently, compared with a case in which these functions are provided as sections or members that differ from each other, it is possible to downsize the flat-conductor connector. In addition, it is possible to cause the urging force of the urging member to act directly on the supporting portion and to reliably rotate and displace the lock member via the supporting portion from the open position to the close position.

The locking portion of the present invention according to claim 1 described above is in one of the following states in (1) to (4). (1) A state in which the locking portion is present at the locking position at which locking portion is completely locked with the flat conductor and in which the lock member is present at the close position at which the lock member is not rotatable. (2) A state in which the locking portion is partially present at the locking position at which the locking portion is locked with the flat conductor and in which the lock member is, however, rotated from the close position. (3) A state in which the locking portion cancels locking with the flat conductor and in which the lock member is, however, in the middle of rotation and does not reach the open position at which the lock member stops the rotation thereof. (4) A state in which the locking portion cancels locking with the flat conductor and in which the lock member is present at the open position at which the lock member stops the rotation in the opening direction. While, in the aforementioned states in (2) to (4), the urging member displaces the locking portion by urging the supporting portion, the urging member can cause the urging force not to act in the aforementioned state in (1) and, in this case, for example, can be disposed such that the urging member is in contact with the supporting portion and the urging force, however, does not act or such that the urging member is not in contact with the supporting portion and the supporting portion, however, comes into contact with the urging member when the lock member is rotated. It is also possible to cause the urging force to act in the aforementioned state in (1), and, in this case, the locking portion can be reliably held at the locking position.

The lock member and the housing according to the present invention can be configured to each include a rotation restriction portion configured to abut, at the open position of the lock member, on the lock member and restrict rotational displacement in the opening direction.

According to the present invention, it is possible to prevent the lock member to be rotated beyond the open position because the lock member and the housing each include the rotation restriction portion configured to abut, at the open position of the lock member, on the lock member and restrict rotational displacement in the opening direction. Consequently, it is possible to prevent the housing from being damaged and the lock member from coming off from the housing.

The supporting portion according to the present invention can be configured to include a cam face that changes a contact position thereof with respect to the urging member such that an urging force received from the spring piece of the urging member is larger when the locking portion is present at the lock cancellation position than when the locking portion is present at the locking position.

According to the present invention, the supporting portion includes the cam face that changes the contact position thereof with respect to the urging member such that the urging force received from the spring piece of the urging member is larger at the lock cancellation position than at the locking position. Consequently, in the present invention, it is possible with a simple urging structure in which a contact position of the urging member is changed with respect to the displaceable cam face to apply a stronger urging force to the supporting portion at the lock cancellation position than at the locking position.

The cam face according to the present invention can be configured to include a flat surface portion with which the urging member comes into surface contact when the locking portion is present at the locking position.

According to the present invention, the urging member comes into surface contact in a large area with the flat surface portion because the cam face includes the flat surface portion with which the urging member comes into surface contact when the locking portion is present at the locking position. Consequently, it is possible to prevent the lock member from rattling and being unexpectedly displaced in a state in which the locking portion stops the flat conductor from slipping off.

The urging member according to the present invention can be configured to be formed by a metal piece and disposed such that a plate surface of the metal piece is along a height direction of the housing chamber along the thickness direction of the flat conductor, and the urging member can be configured to include, at a plate edge along a thickness direction of the metal piece, a locking edge configured to be pressed to come into contact with the supporting portion.

In the flat-conductor connector in PTL 1 described above, the plate spring-shaped engagement piece (41B) having a plate width is formed at a portion of the metal shell (41), and thus, design flexibility of the engagement piece (41B) as a spring piece is restricted, and, moreover, the connector structure including the shell (41) is complicated. In addition, the engagement piece (41B) has a plate spring shape and is disposed at both end portions in the longitudinal direction of the housing (10) at which terminals (20) are not arrayed, and the engagement piece (41B) has a structure in which a plate surface (roll surface) thereof having a plate width is caused to come into contact with the movable member (30), resulting in an increase in the size of the flat-conductor connector in the longitudinal direction of the housing (10). In contrast, according to the present invention, the urging member is formed by the metal piece and disposed such that the plate surface of the metal piece is along the height direction of the housing chamber along the thickness direction of the flat conductor, and the urging member includes, at the plate edge along the thickness direction of the metal piece, the locking edge configured to be pressed to come into contact with the supporting portion. Consequently, in the present invention, it is possible to downsize the flat-conductor connector, compared with a case in which the plate surface (roll surface) of the metal piece of the urging member is configured to be pressed to come into contact with the supporting portion. Such an urging member can be formed by a punched metal fitting formed by subjecting a metal plate to a punching process with a press, and the locking edge can be formed by a cross section of the punched metal fitting. Thus, according to the present invention, it is possible to realize, with a small and simple structure, an automatic stopping mechanism for the lock member in which the urging member urges the lock member in the closing direction because the urging member for urging the supporting portion can be formed by a thin metal piece.

The lock member and the housing according to the present invention can be configured to each include a movement restricting portion at which the lock member abuts, when the locking portion is present at the locking position, on the housing in an extracting direction of the flat conductor.

According to the present invention, the movement restricting portions provided at the lock member and the housing abut on each other, even when the flat conductor is pulled in the extracting direction, in the lock state of the flat conductor in which the locking portion is present at the locking position because the lock member and the housing each include the movement restricting portion at which the lock member abuts, when the locking portion is present at the locking position, on the housing in the extracting direction of the flat conductor. Consequently, it is possible to prevent the lock member from coming off from the housing.

The housing according to the present invention can be configured to include a supporting recess portion configured to house the supporting portion of the lock member.

According to the present invention, it is possible to hold, in the supporting recess portion, the supporting portion urged by the urging member because the housing includes the supporting recess portion configured to house the supporting portion of the lock member. In addition, it is also possible to configure such that, at the close position and the open position of the lock member, the supporting portion is locked with respect to the supporting recess portion in an inserting direction of the flat conductor with respect to the housing chamber.

Consequently, it is possible to prevent the supporting portion from coming off from the supporting recess portion, that is, the lock member from being detached from the housing.

The urging member according to the present invention can be configured to include: a fixed piece portion fixed with respect to the housing; an elastic piece portion extending from the fixed piece portion; a bent portion extending from the elastic piece portion; and a locking piece connecting with the bent portion and configured to be pressed to come into contact with the supporting portion. According to the present invention, due to the urging member including the elastic piece portion and the bent portion and ensuring a long spring length, it is possible to disperse a stress generated as a result of displacement of the locking piece and to cause the urging member not to be easily broken.

In the present invention, it is possible to configure such that an urging-member housing portion at which the urging member is disposed along the inserting direction of the flat conductor with respect to the housing chamber is included between the housing and the lock member. According to the present invention, it is possible, due to the urging-member housing portion included between the housing and the lock member, to displace the elastic piece portion of the urging member from a gap between the housing and the lock member to the outside of the housing and to downsize the flat-conductor connector, compared with a case in which a displacement space for the elastic piece portion is provided in the housing.

Advantageous Effects of Invention

According to a flat-conductor connector of the present invention, due to the urging member having an automatic stopping mechanism for a lock member in which an urging member urges the lock member in a closing direction, it is possible to reliably displace a locking portion of the lock member, which stops a flat conductor from slipping off, from a lock cancellation position to a locking position and to reliably maintain the locking position of the locking portion. Accordingly, a fitting connection operation of a flat conductor after the flat conductor is extracted can be reliably performed again, and it is possible to realize highly reliable conductive connection.

DESCRIPTION OF EMBODIMENTS

Hereinafter, one embodiment of a flat-conductor connector according to the present invention will be described with reference to the drawings. A flat-conductor connector 1 presented in the following embodiment will be described, as an example, as a horizontal connection-type flat-conductor connector 1 configured to be mounted on a substrate P and into which a flat conductor 2, such as a FPC or a FFC, is horizontally inserted along the substrate P to be fitting-connected thereto to thereby conductively connect the flat conductor 2 to a circuit of the substrate P.

Figure 1:
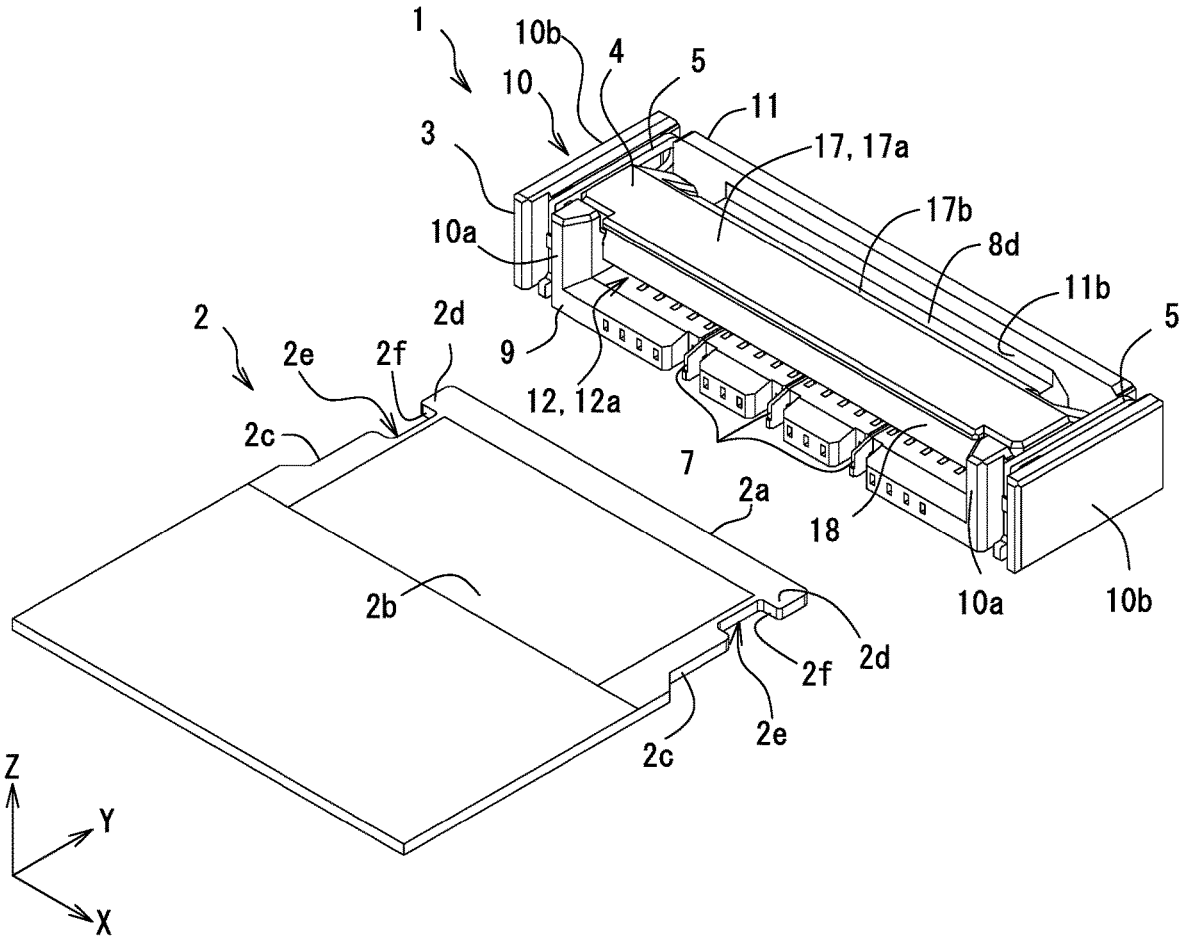
FIG. 1 is a perspective view including a front face, a planar face, and a right face of a flat-conductor connector according to one embodiment.
Figure 2:
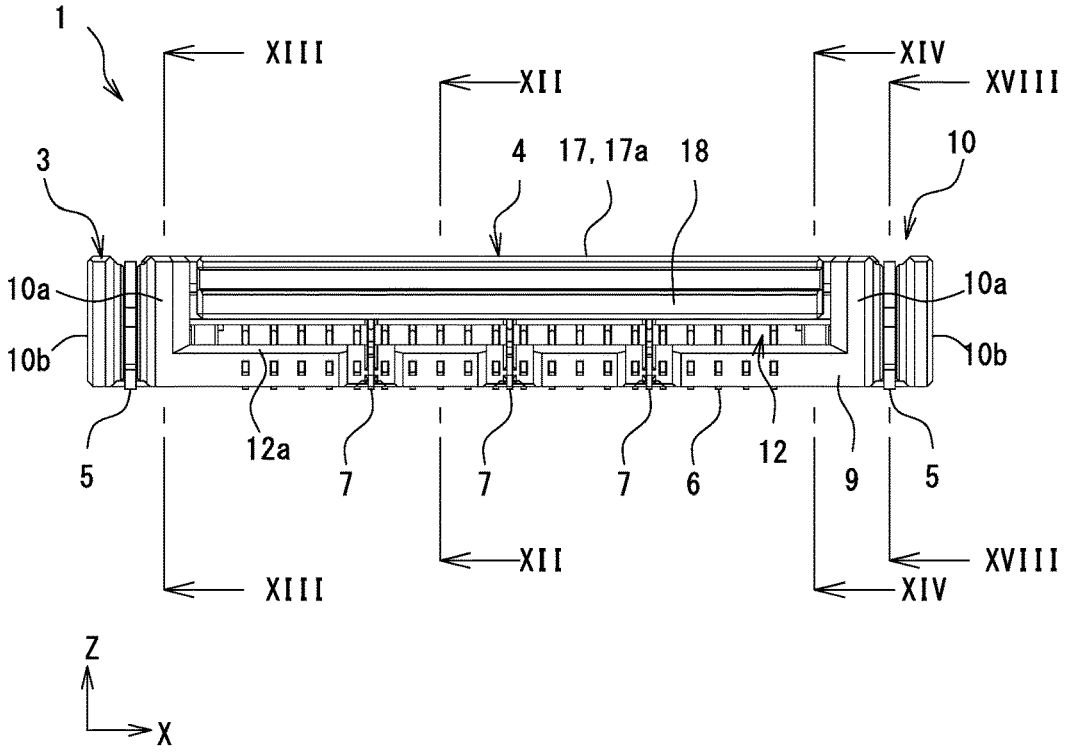
FIG. 2 is a front view of the flat-conductor connector in FIG. 1.

The terms "first" and "second" in the present description and the claims are used to distinguish different constituents of the invention from each other and are not used to indicate specific orders, or superiority or inferiority. In addition, in the present description and the claims, as illustrated in FIG. 1 and the like, the longitudinal direction (width direction, left-right direction), the short direction (depth direction, front-rear direction), and the height direction of the flat-conductor connector 1 are described as the X direction, the Y direction, and the Z direction, respectively, for convenience of describing. The side of the substrate P (refer to FIG. 14 and FIG. 15) in the height direction (Z direction) of the flat-conductor connector 1 and the side of the flat-conductor connector 1 are respectively described as the "lower side" and the "upper side"; these sides, however, do not limit the fitting direction of the flat-conductor connector 1 and the mounting manner thereof with respect to the substrate P.

The flat-conductor connector 1 includes a housing 3, a lock member 4 which stops the fitting-connected flat conductor 2 from slipping off, an urging member 5 which urges the rotatably supported lock member 4 at a close position, a plurality of terminals 6 for signal connection fixed to the housing 3, and a ground terminal 7 for ground connection also fixed to the housing 3.

Figure 13:
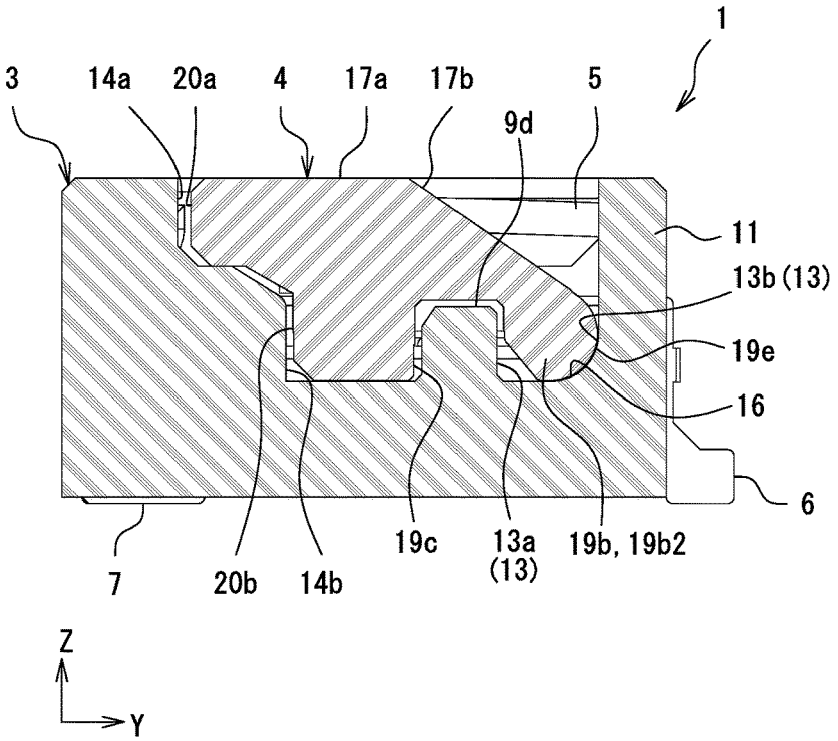
FIG. 13 is a sectional view taken along line XIII-XIII of FIG. 2.
Figure 14:
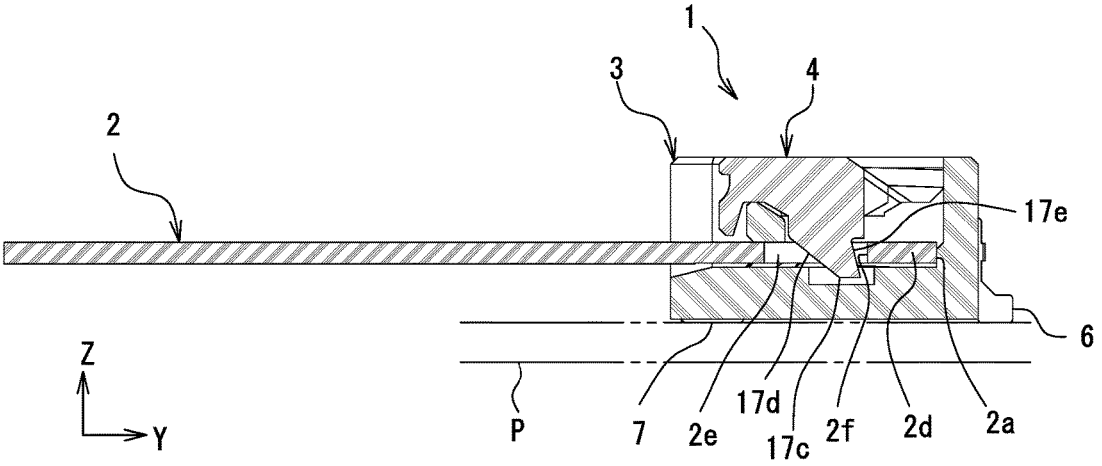
FIG. 14 is a sectional view taken along line XIV-XIV of FIG. 2, illustrating a fitting-connected state of a flat conductor.
Figure 15:
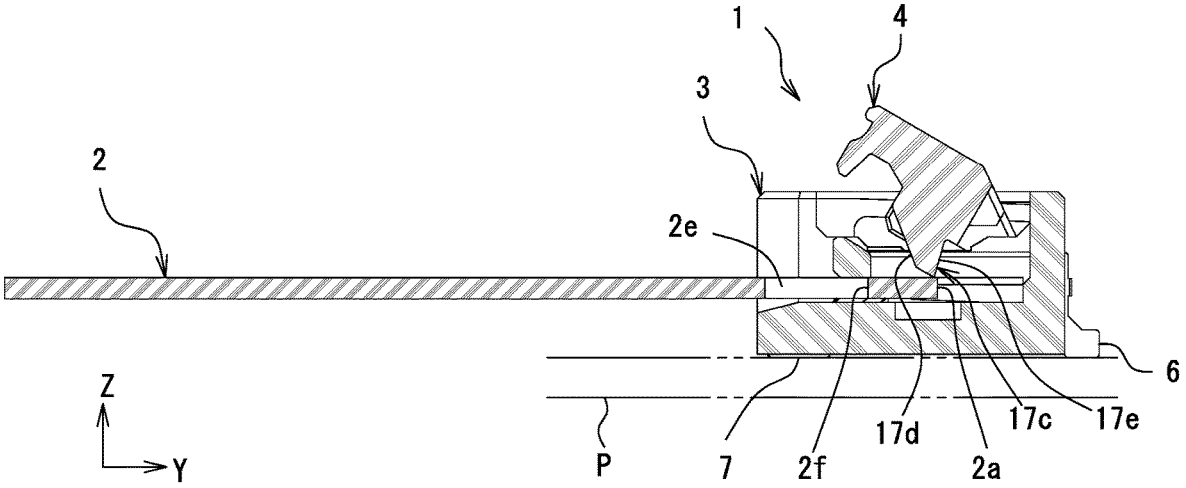
FIG. 15 is a sectional view taken along line XIV-XIV of FIG. 2, illustrating an extracted state of the flat conductor.
Figure 16:
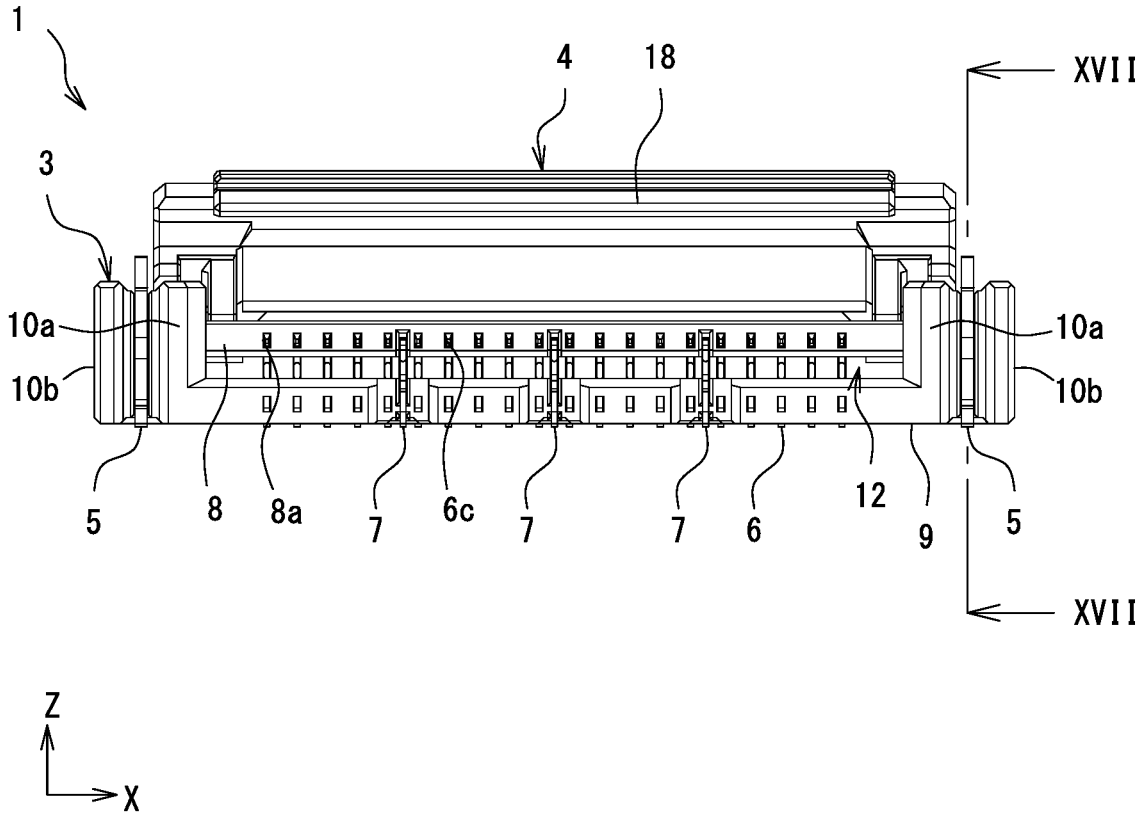
FIG. 16 is a front view of the flat-conductor connector when the lock member is at an open position.
Figure 17:
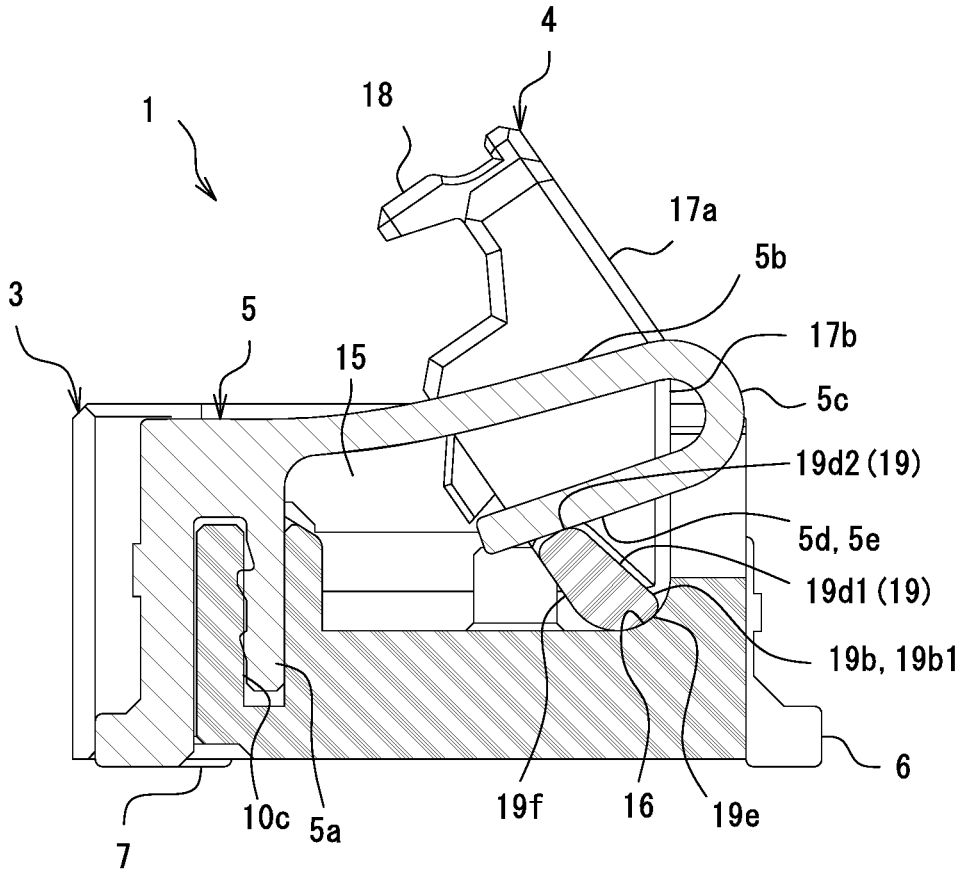
FIG. 17 is a sectional view taken along line XVII-XVII of FIG. 16 when the lock member is at the open position.

In the flat-conductor connector 1, the state illustrated in FIGS. 1, 12 to 14, and 18 is the "close position" of the lock member 4, and the state illustrated in FIGS. 15 to 17 is the "open position" of the lock member 4. The lock member 4 is installed in the housing 3 so as to be displaceable, by being rotated, from an opening direction that is from the close position toward the open position and a closing direction that is from the open position toward the close position. In the fitting-connected state of the flat conductor 2, when the lock member 4 is present at the close position, the lock member 4 (slip-off stop locking surface 17*e*, described later) is present at a "locking position" with respect to the flat conductor 2 and in a "lock state" in which the flat conductor 2 is locked and stopped from slipping off. In the fitting-connected state of the flat conductor 2, when the lock member 4 (slip-off stop locking surface 17*e*) is present at the open position, the lock member 4 is present at a "lock cancellation position" with respect to the flat conductor 2 and in an "unlock state" in which the flat conductor 2 is extractable.

Flat Conductor 2

Hereinafter, first, the flat conductor 2 configured to be fitting-connected with the flat-conductor connector 1 will be described.

As illustrated in FIG. 1, the flat conductor 2 is inserted into the flat-conductor connector 1 with a front end portion 2*a* as a leading end. As illustrated in FIG. 1, the flat conductor 2 includes a ground connection portion 2*b* disposed at a surface of an insulating base material on one side and a conductive contact portion, not illustrated, disposed at a surface of the insulating base material on the other side. In the fitting-connected state between the flat conductor 2 and the flat-conductor connector 1, the ground connection portion 2*b* is in conductive contact with the ground terminal 7, and the conductive contact portion is in conductive contact with the plurality of terminals 6. The ground connection portion 2*b*, the conductive contact portion, and wiring, outside the drawings, to which these portions are connected are held by the insulating base material mentioned above, and an insulating protective layer is formed on both surfaces, excluding the ground connection portion 2*b* and the conductive contact portion, of the flat conductor 2 to protect wiring formed at the insulating base material.

At a side edge 2*c* positioned on each of both sides of the flat conductor 2 in the width direction X, a locking piece 2*d* and a locking recess portion 2*e* are formed. The locking piece 2*d* is formed as a protruding piece formed on each of both sides of the front end portion 2*a* of the flat conductor 2. The locking recess portion 2*e* is formed by a recessed shape lacking in the side edge 2*c*. A projecting portion 17*c* of the lock member 4, which will be described later, is configured to enter the locking recess portion 2*e* in the fitting-connected state between the flat conductor 2 and the flat-conductor connector 1. When the flat conductor 2 is pulled in the extracting direction Y, a locking edge 2*f* of the locking recess portion 2*e* is locked in the extracting direction Y with respect to the slip-off stop locking surface 17*e* as the "locking portion" disposed at the projecting portion 17*c* of the lock member 4, and the flat conductor 2 is thereby stopped from slipping off. Therefore, the flat-conductor connector 1 can stop the flat conductor 2 from slipping off unless the projecting locking piece 2*d* with which the locking edge 2*f* is shared is broken. The locking recess portion 2*e* of the flat conductor 2 may have, instead of the recessed shape, a hole shape or other shapes provided that it is possible to stop the flat conductor 2 from slipping off.

Flat-Conductor Connector 1

Next, the flat-conductor connector 1 will be described.

As described above, the flat-conductor connector 1 is configured to include the housing 3, the lock member 4, the urging member 5, the plurality of terminals 6, and the ground terminal 7.

Housing 3

The housing 3 is formed of an electric insulating resin molded body and includes an upper wall portion 8, a bottom wall portion 9, left and right side wall portions 10, and a rear wall portion 11. On the inner side of the housing 3, a housing chamber 12 for the flat conductor 2 is formed between the upper wall portion 8 and the bottom wall portion 9.

Figure 7:
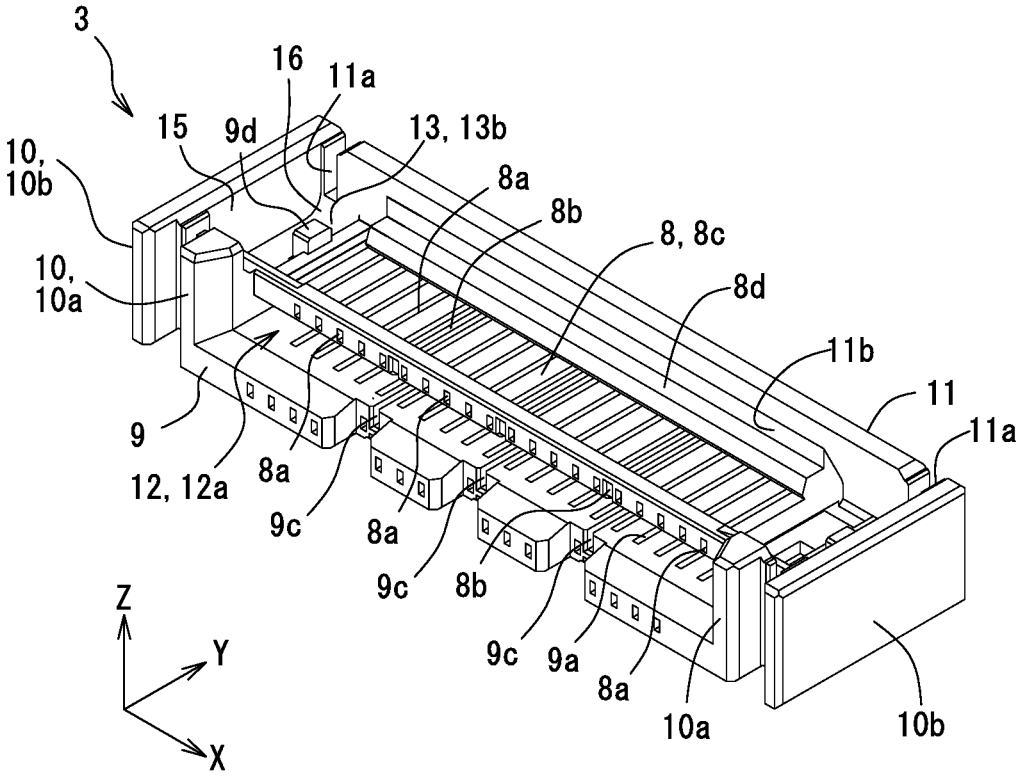
FIG. 7 is a perspective view including a front face, a planar face, and a right face of a housing included in the flat-conductor connector in FIG. 1.
Figure 8:
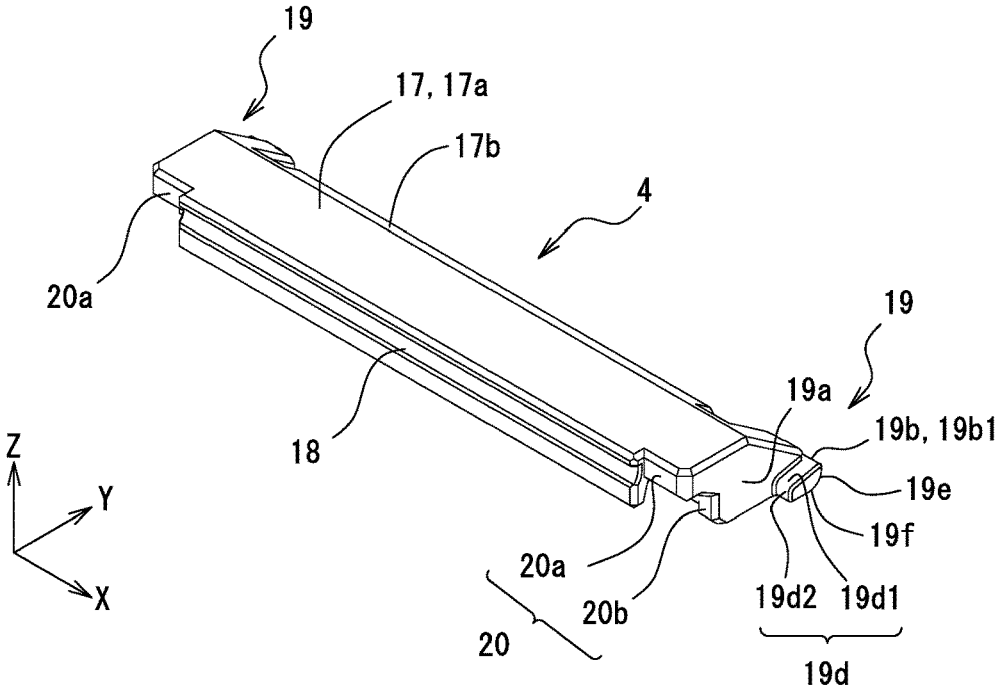
FIG. 8 is a perspective view including a front face, a planar face, and a right face of a lock member included in the flat-conductor connector in FIG. 1.
Figure 9:
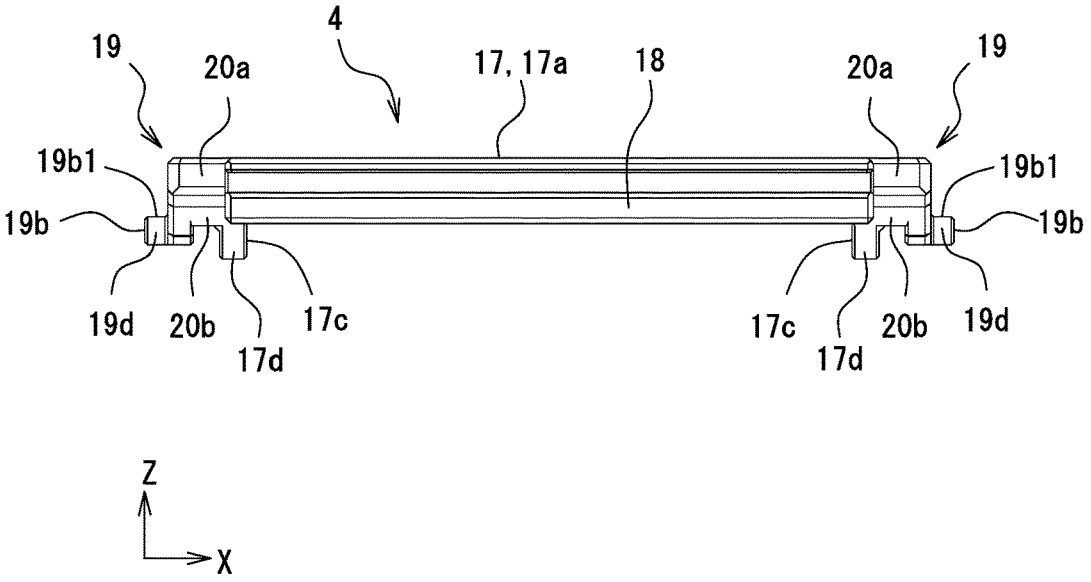
FIG. 9 is a front view of the lock member in FIG. 8.

At the bottom wall portion 9, contact-piece housing grooves 9*a* for housing front contact pieces 6*d* and rear contact pieces 6*e*, which will be described later, of the terminals 6 are formed. The contact-piece housing grooves 9*a* each have a slit shape having an opening 9*b* communicating with the housing chamber 12. The front contact pieces 6*d* and the rear contact pieces 6*e* of the terminals 6 are displaceable inside and outside the contact-piece housing grooves 9*a* in the height direction Z of the housing 3. It is thus possible in the present embodiment to achieve the low profile of the housing 3 in the height direction Z, compared with other housing structures in which the contact-piece housing grooves 9*a* are not provided in the bottom wall portion 9 and in which the terminals 6 are displaced in the inner space of the housing chamber 12. As illustrated in FIG. 7, a ground-terminal fixing groove 9*c* to which the ground terminal 7 is press-fitted and fixed is formed at the bottom wall portion 9. In addition, at the bottom wall portion 9, a projection 9*d* having a square columnar shape is formed. As illustrated in FIG. 13, the projection 9*d* is formed as a front wall 13*a* that forms a supporting recess portion 13 configured to rotatably house a supporting portion 19*b* of the lock member 4, which will be described later, and the lock member 4 in the open state can be thereby held at a predetermined position. A rear wall 13*b* that forms the supporting recess portion 13 in cooperation with the front wall 13*a* is formed as a facing surface of the rear wall portion 11, which will be described later, facing the front wall 13*a*. An inner shaft portion 19*b*2 of the supporting portion 19*b* of the lock member 4, which will be described later, is disposed on the inner side of such a supporting recess portion 13, and is locked by abutting on the front wall 13*a* in the front direction of the front-rear direction Y and locked by abutting on the rear wall 13*b* in the rear direction of the front-rear direction Y. Thus, the inner shaft portion 19*b*2 is restricted in terms of movement in the front-rear direction Y. Therefore, the supporting portion 19*b* disposed on the inner side of the supporting recess portion 13 can hold the lock member 4 at a predetermined position without axial deflection in the front-rear direction Y. Due to the supporting recess portion 13 thus holding the lock member 4, the lock member 4 is held so as not to come off in the front-rear direction Y.

The upper wall portion 8 is positioned to face the bottom wall portion 9 so as to divide the inner space of the housing 3 into an upper portion and a lower portion in the height direction Z. The upper wall portion 8 is formed as a cantilever-shaped wall extending from the rear where the rear wall portion 11 is present toward the front where an insertion port 12*a* is present. Such an upper wall portion 8 has a thin plate thickness not to be bulky in the height direction Z because the upper wall portion 8 is disposed in the inner space of the housing 3. Meanwhile, the flat conductor 2 to be fitting-connected in the housing chamber 12 receives, when being inserted into the housing chamber 12 or in the fitting-connected state after the insertion, a contacting force from all of the terminals 6 from the side of the bottom wall portion 9 and thus abuts on the upper wall portion 8 from below. As described above, the flat-conductor connector 1 of the present embodiment is a connector having a NON-ZIF structure. Therefore, to receive the contacting force of all of the terminals 6 through the flat conductor 2 while achieving the low profile by reducing the plate thickness of the upper wall portion 8, rigidity of the upper wall portion 8 is required to be increased. Thus, at the upper wall portion 8, insertion holes 8*a* into which reinforcing pieces 6*c* of the terminals 6 are inserted along the front-rear direction Y are formed, and the reinforcing pieces 6*c* reinforce the upper wall portion 8. In addition, at the upper wall portion 8, a ground-contact-piece housing groove 8*b* that houses the ground contact piece 7*a* of the ground terminal 7 so as to be displaceable is formed. The ground contact piece 7*a* is disposed in the ground-contact-piece housing groove 8*b* so as to be displaceable to the inside of the housing chamber 12 through an opening of the ground-contact-piece housing groove 8*b* communicating the housing chamber 12. At the upper surface of the upper wall portion 8, a placement face 8*c* for the lock member 4 present at the close position, which will be described later, is formed, and the lock member 4 present at the close position is held in a state of being housed within a range of the height of the housing 3 by being placed at the placement face 8*c*. As described above, the upper wall portion 8 has a thin plate thickness and, specifically, the upper wall portion 8 is formed to be thin as a result of the insertion holes 8*a* for the reinforcing pieces 6*c* being exposed, at tip portions and intermediate portions excluding a proximal-end-side portion of the reinforcing pieces 6*c*, at the placement face 8*c*. In other words, no resin wall that covers the reinforcing pieces 6*c* is present at this portion, and the placement face 8*c* thus has a recessed shape. Consequently, the plate thickness at the portion is formed to be thin. At the rear of the placement face 8*c*, an abutting wall 8*d*, which forms a portion of the "rotation restriction portion", is formed, and, as a result of the lock member 4 rotated to the open position abutting on the abutting wall 8*d*, excessive rotation of the lock member 4 in the opening direction is restricted, thereby preventing the housing 3 from being damaged and the lock member 4 from coming off from the housing 3.

The left and right side wall portions 10 are formed to be left-right symmetric. At each of the side wall portions 10, a front inner wall 10*a* that forms the insertion port 12*a* of the housing chamber 12 into which the flat conductor 2 is to be inserted is formed at a front portion of the housing 3. At the front inner wall 10*a*, a movement restricting portion 14 on which the lock member 4 present at the close position abuts in the extracting direction Y of the flat conductor 2 is formed. Specifically, as illustrated in FIG. 13, at the front inner wall 10*a*, an upper abutting surface 14*a* and a lower abutting surface 14*b* are formed at a wall surface positioned on the side opposite to the insertion port 12*a*, and these abutting surfaces form the movement restricting portion 14 in the housing 3. At each of the side wall portions 10, an outer wall 10*b* extending on the outer side of the front inner wall 10*a* in the front-rear direction is formed. Between the outer wall 10*b* and the front inner wall 10*a*, as illustrated FIGS. 17 and 18, an urging-member fixing portion 10*c* to which the urging member 5 is press-fitted and fixed is formed. A slit-shaped gap (space) formed between the inner surface of the outer wall 10*b* and the lock member 4 is formed as an urging-member housing portion 15 for disposing the urging member 5 fixed to the urging-member fixing portion 10*c* so as to be displaceable. The urging-member housing portion 15 is formed to include a groove 11*a* formed in the rear wall portion 11.

The rear wall portion 11 is formed along the width direction X of the housing 3 so as to have the same height as that of the side wall portions 10. At both end portions of the rear wall portion 11, the groove 11*a* constituting a portion of the aforementioned urging-member housing portion 15 is formed. In addition, at the rear wall portion 11, an abutting wall 11*b*, which forms a portion of the "rotation restriction portion" is formed. The lock member 4 rotated to the open position abuts on the abutting wall 11*b*, and the lock member 4 is thereby restricted from being rotated excessively in the opening direction. As described above, the housing 3 is configured to prevent the housing 3 from being damaged and the lock member 4 from coming off by using the abutting wall 8*d* of the upper wall portion 8 and the abutting wall 11*b* of the rear wall portion 11 as the "rotation restriction portion" in the housing 3 to restrict excessive rotation of the lock member 4 in the opening direction.

As illustrated in FIGS. 7, 13, 17, and 18, a curved boundary surface between the bottom wall portion 9 adjacent to the side wall portions 10 and the rear wall portion 11 and a flat portion of the bottom wall portion 9 connecting to the boundary surface portion are formed as a rotation support surface portion 16. The rotation support surface portion 16 is in contact with a first rotation surface 19*e* and a second rotation surface 19*f* of the supporting portion 19*b* when the lock member 4, which will be described later, is present at the close position and is in contact with the first rotation surface 19*e* of the supporting portion 19*b* and serves as a section that supports the rotation thereof when the lock member 4 is present at the open position.

Lock Member 4

The lock member 4 is formed of a single resin molded body having electric insulation. The lock member 4 includes a body portion 17 extending along the width direction X, a front wall portion 18, and left and right side wall portions 19.

The body portion 17 includes a flat portion 17*a* and an inclined portion 17*b* formed at the rear of the flat portion 17*a*. The flat portion 17*a* is formed not to project above the housing 3 when the lock member 4 is at the close position, and the low profile of the flat-conductor connector 1 is thereby achieved. The inclined portion 17*b* is a portion that serves as the "rotation restriction portion" in the lock member 4. In other words, the inclined portion 17*b* of the lock member 4 rotated to the open position abuts on the abutting wall 8*d* of the upper wall portion 8 and the abutting wall 11*b* of the rear wall portion 11, which are the "rotation restriction portion" on the side of the aforementioned housing 3 and can thereby stop excessive rotation of the lock member 4 in the opening direction. Therefore, it is possible to prevent the housing 3 from being damaged and the lock member 4 from coming off from the housing 3.

The front wall portion 18 is disposed so as to cover the front of the front end portion of the upper wall portion 8 when the lock member 4 is at the close position. Consequently, in the fitting-connected state of the flat conductor 2, the insertion holes 8*a* opening at the front end portion of the upper wall portion 8 are not exposed to the outside. The reinforcing pieces 6*c* of the terminals 6 conducted in the fitting-connected state are inserted into the insertion holes 8*a* to prevent foreign matters and the like from coming, from outside, into contact with the reinforcing pieces 6*c* through the openings of the insertion holes 8*a*.

At each of the side wall portions 19, a side wall 19*a* and the supporting portion 19*b* are formed.

Figure 10:
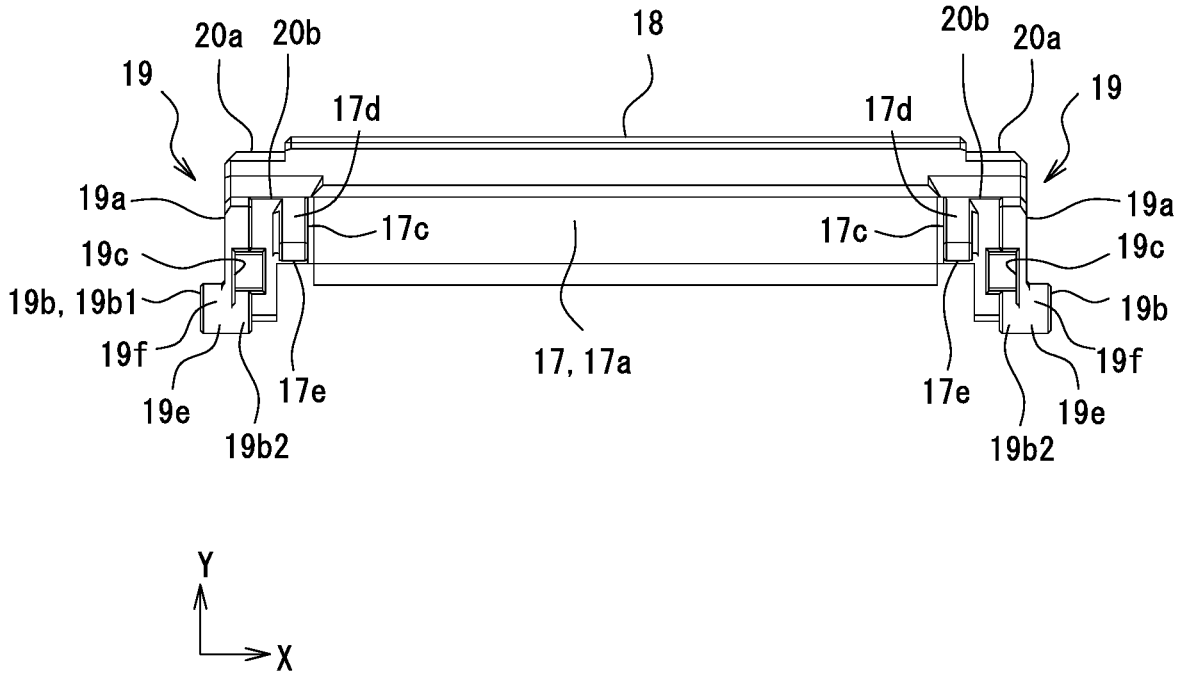
FIG. 10 is a bottom view of the lock member in FIG. 8.
Figure 11:
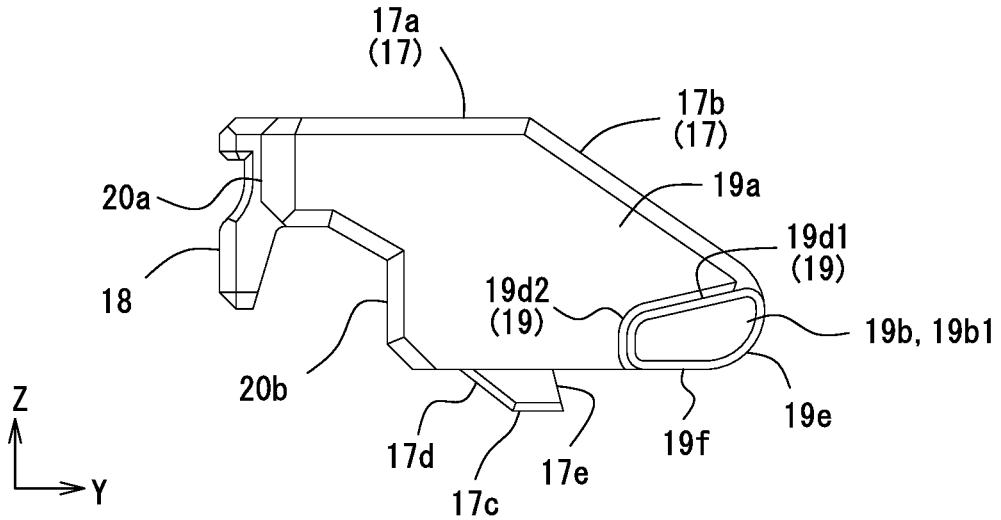
FIG. 11 is a right view of the lock member in FIG. 8.
Figure 12:
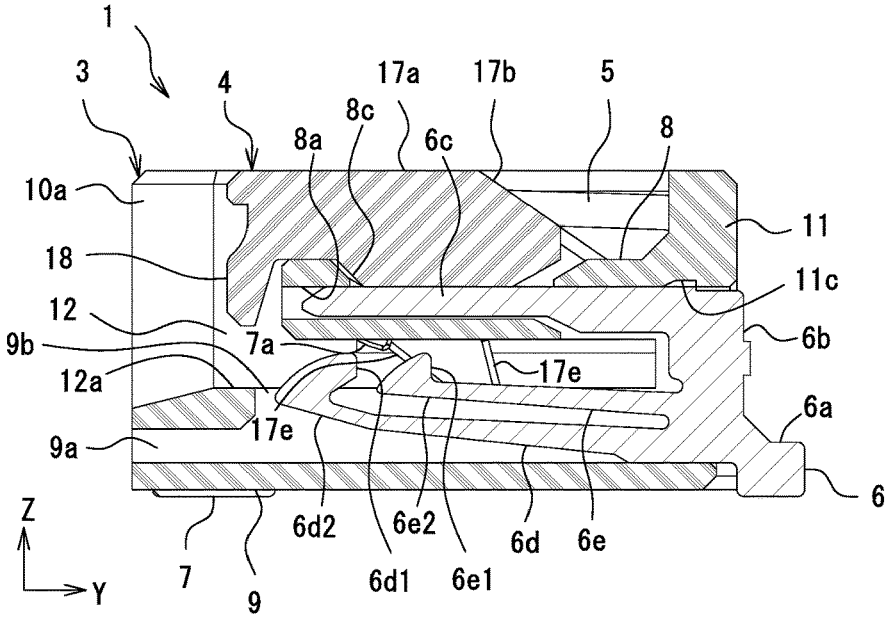
FIG. 12 is a sectional view taken along line XII-XII of FIG. 2.

The side wall 19*a* has a plate shape projecting from the body portion 17 toward the housing 3. At the front surface of the side wall 19*a*, an upper abutting surface 20*a* and a lower abutting surface 20*b* that form a movement restricting portion 20 on the side of the lock member 4 are formed. The upper abutting surface 20*a* is positioned to face the upper abutting surface 14*a* of the movement restricting portion 14 of the housing 3, and the lower abutting surface 20*b* is positioned to face the lower abutting surface 14*b* of the movement restricting portion 14 of the housing 3. When the flat conductor 2 in the fitting-connected state is pulled in the extracting direction Y, the upper abutting surface 20*a* and the lower abutting surface 20*b* of the lock member 4 abut on the upper abutting surface 14*a* and the lower abutting surface 14*b* of the housing 3 opposite thereto, thereby restricting movement of the lock member 4 and preventing the lock member 4 from being detached from the housing 3. In addition, as illustrated in FIGS. 10 and 13, a recessed portion 19*c* into which the projection 9*d* disposed at the bottom wall portion 9 is inserted when the lock member 4 is present at the close position is formed at the bottom surface of each side wall 19*a*.

The supporting portion 19*b* is formed to have an outer shaft portion 19*b*1 projecting on the side of the side wall 19*a* and having a laterally long elliptic columnar shape that is long in the front-rear direction Y. At the outer circumference surface along the circumference direction of the outer shaft portion 19*b*1, a cam face 19*d* with which the urging member 5, which will be described later, comes into contact is formed. The cam face 19*d* includes a flat first locking surface 19*d*1, as the "flat portion", and a curved second locking surface 19*d*2 bending from the front end of the first locking surface 19*d*1. At the rear of the cam face 19*d*, the curved first rotation surface 19*e* that rotates by receiving the support of the aforementioned rotation support surface portion 16 when the lock member 4 is rotated between the close position and the open position is formed. At a location opposite to the first locking surface 19*d*1 connecting from the first rotation surface 19*e*, the flat second rotation surface 19*f* is formed. In addition, at the supporting portion 19*b*, the inner shaft portion 19*b*2 positioned on the rear side of the recessed portion 19*c* is formed. As described in the description of the bottom wall portion 9 of the housing 3, the inner shaft portion 19*b*2 is disposed on the inner side of the supporting recess portion 13 and is locked in the front direction of the front-rear direction Y by abutting on the front wall 13*a* and locked in the rear direction of the front-rear direction Y by abutting on the rear wall 13*b*.

On the rear surface of the aforementioned body portion 17, the projecting portion 17*c* projecting toward the housing chamber 12 of the housing 3 is formed at a location adjacent to the recessed portion 19*c* formed at the bottom surface of each side wall 19*a* described above. At each projecting portion 17*c*, a rotation guiding surface 17*d* facing the insertion port 12*a* of the housing chamber 12 is formed. At a location opposite to the rotation guiding surface 17*d* of each projecting portion 17*c*, the slip-off stop locking surface 17*e*, as the "locking portion", is formed.

Urging Member 5

The urging member 5 is formed by a punched metal fitting formed by punching a metal plate with a press through a punching process. The urging member 5 is housed in the aforementioned urging-member housing portion 15 and includes: a fixed piece portion 5*a* configured to be press-fitted and fixed to the urging-member fixing portion 10*c* of the housing 3; an elastic piece portion 5*b* linearly extending from the fixed piece portion 5*a* in the front-rear direction Y; a bent portion 5*c* bent at the rear of the elastic piece portion 5*b* so as to be folded back toward the front; and a locking piece portion 5*d* linearly extending from the bent portion 5*c*.

The elastic piece portion 5*b*, the bent portion 5*c*, and the locking piece portion 5*d* are formed as "spring pieces" supported by the fixed piece portion 5*a* and ensure the length of the housing 3, as a spring piece, in the front-rear direction Y. Consequently, durability as a spring piece durable against repeated rotation operations of the lock member 4 is realized.

The elastic piece portion 5*b* extends in the urging-member housing portion 15 so as not to project from the upper surface of the housing 3 and reaches the groove 11*a* of the rear wall portion 11. The bent portion 5*c* is disposed in the groove 11*a* and is deformable. When the urging member 5 is elastically deformed by the rotation of the lock member 4, the urging member 5 can be deformed, as illustrated in FIG. 17, such that the elastic piece portion 5*b* and the bent portion 5*c* project to the outside from the upper surface of the housing 3 because the urging-member housing portion 15 including the groove 11*a* opens to the outside. Therefore, it is possible to achieve the low profile of the housing 3, compared with a case in which a displacement space for the elastic piece portion 5*b* and the bent portion 5*c* is provided on the inner side of the housing 3.

At the locking piece portion 5*d*, a locking edge 5*e* configured to be pressed to come into contact with the cam face 19*d* of the supporting portion 19*b* of the lock member 4 is formed. The locking piece portion 5*d* urges the cam face 19*d* so as to press the first rotation surface 19*e* and the second rotation surface 19*f* of the supporting portion 19*b* against the rotation support surface portion 16 of the housing 3. The force with which the locking edge 5*e* is pressed to come into contact with the cam face 19*d* is generated by the elastic deformation of the elastic piece portion 5*b*, the bent portion 5*c*, and the locking piece portion 5*d*.

The urging member 5 of the present embodiment is configured to constantly urge the supporting portion 19*b* in any of the following states in (1) to (4).

(1) A state in which the slip-off stop locking surface 17*e* is present at the locking position at which the slip-off stop locking surface 17*e* is locked with the locking edge 2*f* of the flat conductor 2 and in which the lock member 4 is present at the close position at which the lock member 4 is not rotatable.

(2) A state in which a portion of the slip-off stop locking surface 17*e* along the length direction thereof is present at the locking position at which the slip-off stop locking surface 17*e* is locked with the locking edge 2*f* and in which the lock member 4 is, however, rotated and away from the close position.

(3) A state in which the slip-off stop locking surface 17*e* cancels locking with the locking edge 2*f* and in which the lock member 4 is, however, in the middle of rotation and does not reach the open position at which the lock member 4 stops the rotation thereof.

(4) A state in which the slip-off stop locking surface 17*e* cancels locking with the locking edge 2*f* and in which the lock member 4 is present at the open position at which the lock member 4 stops the rotation in the opening direction.

Terminal 6

As with the urging member 5, the terminals 6 are formed by flat plate-shaped punched terminals formed by punching metal plates with a press through a punching process. A plurality of the terminals 6 are disposed adjacent to each other in the width direction X of the housing 3. As illustrated FIG. 12, each terminal 6 includes a substrate connection portion 6*a* to be soldered to the substrate P, and a fixed base portion 6*b* to be press-fitted from the rear side of the rear wall portion 11 into a terminal fixing portion 11*c* disposed at the rear wall portion 11 of the housing 3.

At an upper portion of the fixed base portion 6*b*, the reinforcing piece 6*c* linearly extending in a cantilever beam shape and to be inserted into the insertion hole 8*a* of the upper wall portion 8 is formed.

At a lower portion of the fixed base portion 6*b*, the front contact piece 6*d* and the rear contact piece 6*e* extending in a cantilever beam shape toward the insertion port 12*a* are formed. At the front contact piece 6*d* and the rear contact piece 6*e*, a front contact point 6*d*1 and a rear contact point 6*e*1 that are to be in conductive contact with the conductive contact portion (not illustrated) of the flat conductor 2, which is a connection target thereof, are formed, respectively. These contact points are supported so as to be displaceable by a front elastic arm 6*d*2 and a rear elastic arm 6*e*2, respectively. The front elastic arm 6*d*2 and the rear elastic arm 6*e*2 are disposed at the contact-piece housing groove 9*a* disposed within the plate thickness of the bottom wall portion 9 of the housing 3. The front contact point 6*d*1 and the rear contact point 6*e*1 are disposed so as to project in the housing chamber 12 from the contact-piece housing groove 9*a*.

Ground Terminal 7

Figure 3:
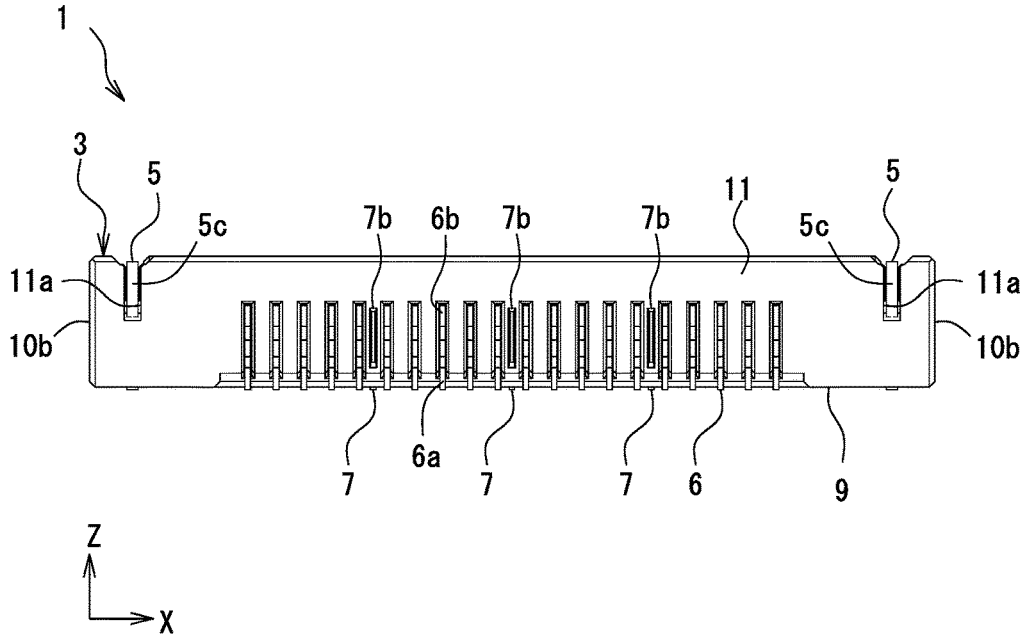
FIG. 3 is a rear view of the flat-conductor connector in FIG. 1.
Figure 4:
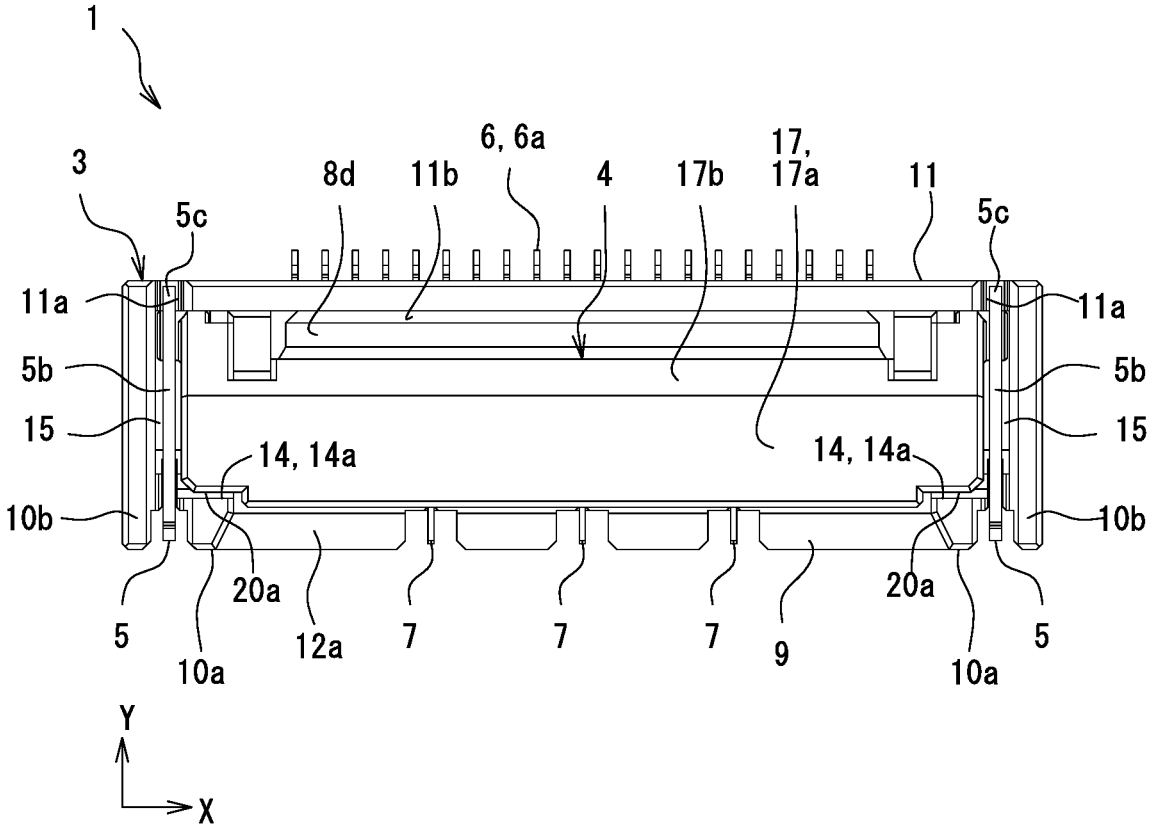
FIG. 4 is a plan view of the flat-conductor connector in FIG. 1.
Figure 5:
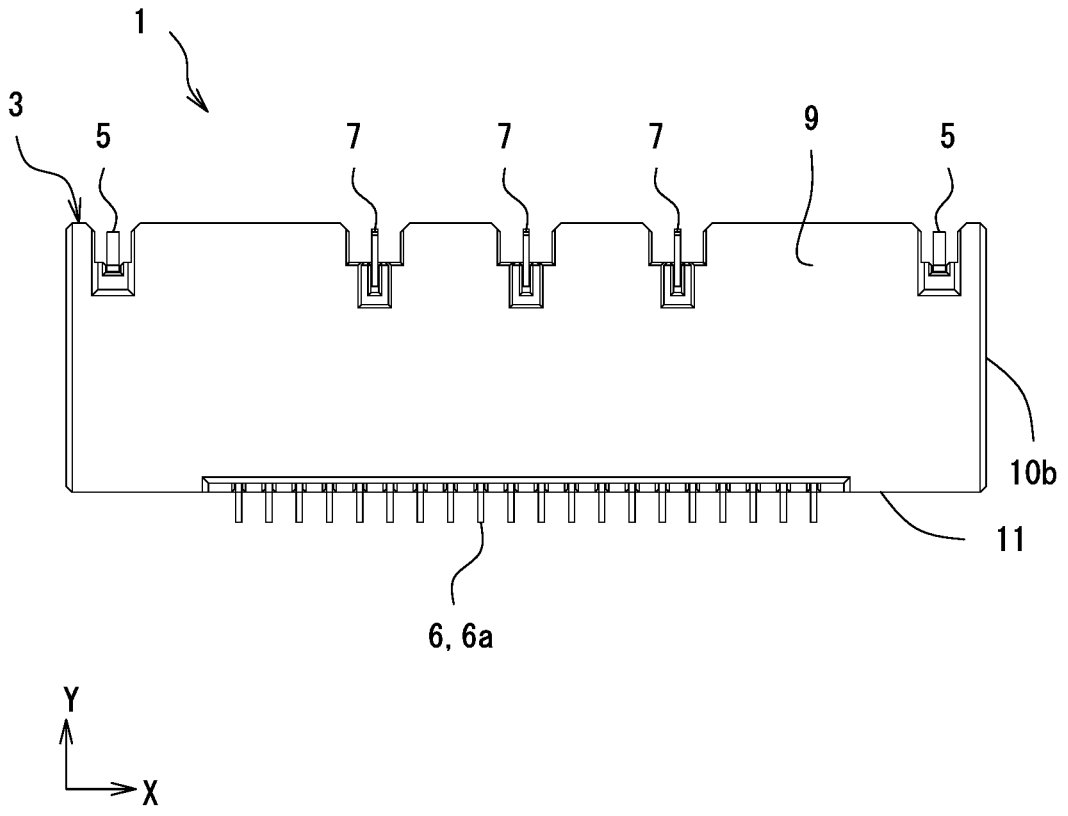
FIG. 5 is a bottom view of the flat-conductor connector in FIG. 1.
Figure 6:
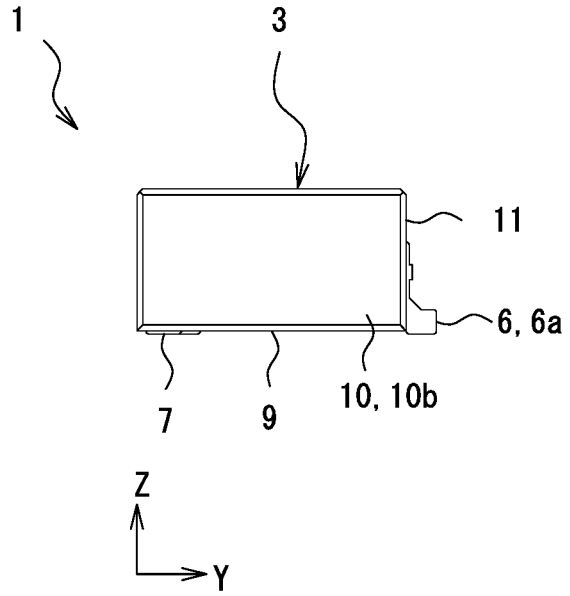
FIG. 6 is a right view of the flat-conductor connector in FIG. 1.

The ground terminal 7 includes the ground contact piece 7*a* and the fixed piece portion, which is not illustrated. The ground contact piece 7*a* is housed in the ground-contact-piece housing groove 8*b* of the upper wall portion 8 of the housing 3. The fixed piece portion is press-fitted and fixed to the ground-terminal fixing groove 9*c* of the bottom wall portion 9 of the housing 3. Consequently, the ground terminal 7 includes a coupling piece portion 7*b* coupling, on the side of the rear wall portion 11, the ground contact piece 7*a* and the fixed piece portion to each other in the height direction Z of the housing 3 (FIG. 3).

Using Method of Flat-Conductor Connector 1

Next, a using method and operation of the flat-conductor connector 1 having the structure described above will be described.

Flat-Conductor Connector 1 in Non-Fitting-Connected State of Flat Conductor 2

Figure 18:
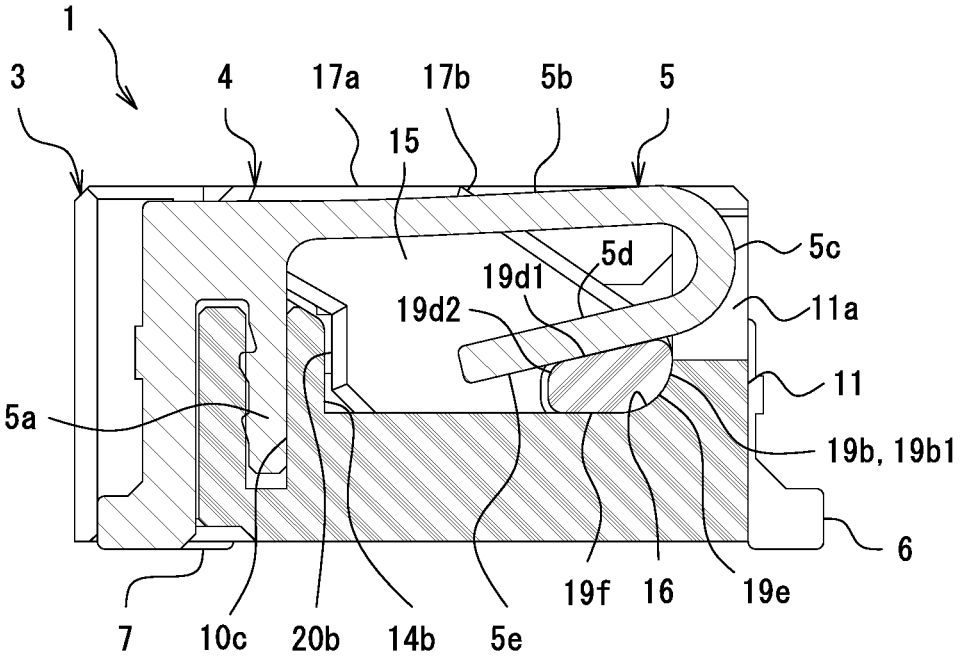
FIG. 18 is a sectional view taken along line XVIII-XVIII of FIG. 2.

As illustrated in FIG. 18, before the flat conductor 2 is inserted into the flat-conductor connector 1, the lock member 4 is present at the close position. At this time, the cam face 19*d* of the supporting portion 19*b* of the lock member 4 is constantly urged with the locking piece portion 5*d* of the urging member 5 being pressed to come into contact with the cam face 19*d*. Specifically, the locking edge 5*e* of the locking piece portion 5*d* is in surface contact in a pressed state with the flat first locking surface 19*d*1 of the cam face 19*d*. As a result of the locking piece portion 5*d* being thus in surface contact in a wide area with the flat first locking surface 19*d*1, the first rotation surface 19*e* and the second rotation surface 19*f* of the supporting portion 19*b* can be constantly pressed against the rotation support surface portion 16, and, consequently, the lock member 4 can reliably maintain the close position. Therefore, in the non-fitting-connected state of the flat conductor 2, the lock member 4 is prevented from rattling with respect to the housing 3 and from coming off by receiving an external force.

Fitting Connection Method of Flat Conductor 2

Next, to fitting-connect the flat conductor 2 to the flat-conductor connector 1, the flat conductor 2 is inserted through the insertion port 12*a* of the housing 3 into the housing chamber 12. During insertion of the flat conductor 2 into the housing chamber 12, the front end portion 2*a* of the flat conductor 2 first abuts on the front contact point 6*d*1 of the front contact piece 6*d* and downwardly presses the front contact point 6*d*1 toward the groove bottom of the contact-piece housing groove 9*a*. Next, the front end portion 2*a* comes into contact with the ground contact piece 7*a* and presses up the ground contact piece 7*a* to the ground-contact-piece housing groove 8*b*. In addition, the front end portion 2*a* comes into contact with the rear contact point 6*e*1 of the rear contact piece 6*e* and presses down the rear contact point 6*e*1 to the contact-piece housing groove 9*a*. As described above, the flat conductor 2 is configured to be pressed to come into contact with each of the front contact point 6*d*1, the ground contact piece 7*a*, and the rear contact point 6*e*1; however, as there is a gap between the timings of contacts, an insertion force with respect to them can be dispersed, as an operation feeling that an operator feels at the hands, without acting at one time, and it is thus possible to insert the flat conductor 2 with a relatively light insertion force.

When insertion of the flat conductor 2 is continued, the front end portion 2*a* (locking piece 2*d*) thereof abuts on each of the two projecting portions 17*c* of the lock member 4 projecting at an insertion path for the flat conductor 2 in the housing chamber 12. There is also a gap between the timing of abutting of the locking piece 2*d* with respect to the projecting portion 17*c* and the timing of contact between the aforementioned terminals 6 and the ground terminal 7, and it is thus possible to insert the flat conductor 2 with a relatively light insertion force.

By being guided by an inclined surface of the rotation guiding surface 17*d* of the projecting portion 17*c*, the locking piece 2*d* presses the rotation guiding surface 17*d* upwardly, as illustrated in FIG. 15, while advancing so as to be placed on the lower side of the inclined surface. The rotation guiding surface 17*d* can press and cause the flat conductor 2 to advance smoothly since the rotation guiding surface 17*d* is an inclined surface.

While the locking piece 2*d* of the flat conductor 2 presses up the rotation guiding surface 17*d*, the urging member 5 constantly urges the supporting portion 19*b* of the lock member 4, as described above. Therefore, while the flat conductor 2 is inserted against the urging force of the urging member 5, the first rotation surface 19*e* of the supporting portion 19*b* is gradually rotated along a curved surface of the rotation support surface portion 16, and the lock member 4 is thereby started to rotate from the close position toward the open position. In other words, the supporting portion 19*b* functions as a rotation shaft of the lock member 4. Due to the urging member 5 constantly urging the supporting portion 19*b* while the first rotation surface 19*e* is rotated along the rotation support surface portion 16, the first rotation surface 19*e* is rotated in close contact, without being displaced, with respect to the rotation support surface portion 16. Therefore, the lock member 4 can be smoothly rotated with the rotation shaft not being displaced by rattling during rotation in the opening direction.

When the flat conductor 2 is further continued to be inserted, the locking piece 2*d* of the flat conductor 2 passes (FIG. 15) the apex of the projecting portion 17*c* of the lock member 4, and, thereafter, as illustrated in FIG. 14, the projecting portion 17*c* enters the locking recess portion 2*e* of the side edge 2*c* of the flat conductor 2. At this time, since the supporting portion 19*b* of the lock member 4 is constantly urged by the urging member 5, the projecting portion 17*c* automatically falls down into the locking recess portion 2*e* due to the urging force. Consequently, the flat conductor 2 can be fitting-connected with respect to the flat-conductor connector 1.

As described above, the flat-conductor connector 1 realizes an automatic lock mechanism configured to fitting connect and stop the flat conductor 2 from slipping off by only an operation of inserting the flat conductor 2 into the housing chamber 12 of the housing 3.

Slip-Off Stopping Function of Flat Conductor 2

In the fitting-connected state of the flat conductor 2, as with in the non-fitting-connected state, the locking edge 5*e* of the locking piece portion 5*d* is in surface contact with and constantly urges the first locking surface 19*d*1 of the cam face 19*d*, and thus, the lock member 4 reliably maintains the close position and stops the flat conductor 2 from slipping off. In other words, when the flat conductor 2 is pulled in the extracting direction Y, the locking edge 2*f* of the locking piece 2*d* of the flat conductor 2 is locked with respect to the slip-off stop locking surface 17*e* of the projecting portion 17*c*. At this time, the lock member 4 is also pulled in the extracting direction Y; however, movement of the lock member 4 is restricted by the movement restricting portion 20 of the lock member 4 abutting on the movement restricting portion 14 of the housing 3. Therefore, a force to extract the flat conductor 2 can be received by the housing 3 through the lock member 4, and it is thus possible to reliably stop the flat conductor 2 from slipping off and to suppress the locking piece 2*d* of the flat conductor 2 from being broken.

Method of Extracting Flat Conductor 2

To extract the flat conductor 2 in the fitting-connected state, the lock member 4 is raised upward with the front wall portion 18 of the lock member 4 being hooked on fingers. The lock member 4 is rotated from the close position to the open position due to the first rotation surface 19*e* of the supporting portion 19*b* being rotated along the rotation support surface portion 16 of the housing 3. During this rotation operation, an operator sometimes rotates the lock member 4 unexpectedly with a strong force. In such a case, as illustrated in FIG. 17, the lock member 4 can be stopped to be further rotated, by the inclined portion 17*b*, having a large area, of the lock member 4 abutting on the abutting wall 8*d* of the upper wall portion 8 and the abutting wall 11*b* of the rear wall portion 11 of the housing 3. Therefore, it is possible to protect the housing 3 from, for example, being damaged due to excessive rotation operation of the lock member 4. In addition, it is possible to prevent the lock member 4 from coming off from the housing 3.

When the lock member 4 is rotated to the open position and opened, the projecting portion 17*c* is extracted from the locking recess portion 2*e* beyond the thickness of the flat conductor 2, and thus, the flat conductor 2 can be easily extracted from the housing chamber 12 when being pulled in the extracting direction Y. When the lock member 4 is at the open position, the locking edge 5*e* of the locking piece portion 5*d* of the urging member 5 abuts on the second locking surface 19*d*2 of the cam face 19*d*. Even when abutting on the second locking surface 19*d*2, the urging member 5 constantly urges the first rotation surface 19*e* toward the rotation support surface portion 16. Therefore, when an operator removes the fingers from the lock member 4, the lock member 4 are automatically rotated from the open position toward the close position. During this process, the locking piece portion 5*d* changes, from the second locking surface 19*d*2 to the first locking surface 19*d*1, a position pressed and in contact with the cam face 19*d*. Consequently, the flat-conductor connector 1 can be returned in the initial non-fitting-connected state.

Action and Effect of Flat-Conductor Connector 1

Next, actions and effects, excluding those already described, of the flat-conductor connector 1 will be described.

The supporting portion 19*b* of the lock member 4 has both a function of receiving urging of the urging member 5 at the outer shaft portion 19*b*1 and a function as the rotation shaft that rotatably supports the lock member 4 at the inner shaft portion 19*b*2. Therefore, compared with a case in which these functions are provided as different sections or members, the flat-conductor connector 1 can be downsized.

The flat-conductor connector 1 can cause the urging force of the urging member 5 to directly act on the supporting portion 19*b* that functions as the rotation shaft. Therefore, compared with a case in which the urging force of the urging member 5 is caused to act on other sections of the lock member 4, the lock member 4 can be reliably rotated and displaced from the open position to the close position.

In the cam face 19*d* of the supporting portion 19*b*, a contact position with respect to the urging member 5 is displaced such that the urging member 5 (the elastic piece portion 5*b*, the bent portion 5*c*, and the locking piece portion 5*d*) is largely displaced more with the lock member 4 at the open position (lock cancellation position) than at the close position (locking position). Therefore, a stronger urging force can be applied to the supporting portion 19*b* at the open position than at the close position with a simple urging structure configured to change a contact position of the locking piece portion 5*d* of the urging member 5 with respect to the cam face 19*d* that is displaceable. Consequently, it is possible to more reliably rotate the lock member 4 to the close position.

The urging member 5 is disposed in the housing 3 such that a flat plate surface thereof is in parallel to plate surfaces of a plurality of the terminals 6 arranged in the housing chamber 12 and has, at a plate edge along the thickness direction thereof, the locking edge 5*e* configured to be pressed to come into contact with the supporting portion 19*b*. Therefore, compared with a case in which the plate surface of the metal piece of the urging member is pressed to come into contact with the supporting portion 19*b*, the flat-conductor connector 1 can be downsized in the width direction X. Such an urging member 5 can be formed by a punched metal fitting formed by subjecting a metal plate to a punching process with a press, and the locking edge 5*e* can be formed by a cross section of the punched metal fitting. Since the urging member 5 that constantly urges the supporting portion 19*b* can be thus formed by a thin metal piece, a mechanism for automatically stopping the lock member 4 in which the urging member 5 constantly urges the lock member 4 in the closing direction can be realized with a small and simple structure.

Modification of Embodiment

In the aforementioned embodiment, the flat-conductor connector 1 of a horizontal connection type in which the flat conductor 2 is horizontally inserted along the substrate P and fitting-connected to thereby conductively connect the flat conductor 2 to the substrate circuit has been described as an example. The present invention is, however, not limited to the horizontal connection type and can be configured as a flat-conductor connector of a vertical connection type in which the flat conductor 2 is vertically fitting-connected with respect to the substrate P. In this case, for example, such a flat-conductor connector can be realized by adding modification, such as changing the shape of the substrate connection portions 6*a* of the terminals 6.

In the aforementioned embodiment, an example in which the urging member 5 is formed of a metal piece is presented. The urging member 5, however, may be formed of a hard resin piece provided that the hard resin piece functions as a spring piece. In addition, when the urging member 5 is formed by the hard resin piece, the hard resin piece may be formed as a portion of the housing 3. In other words, the urging member may be configured to be provided as a resin molded body integral with the housing 3.

In the aforementioned embodiment, an example in which the lock member 4 is formed by a single resin molded body. However, a plurality of members may be combined together to configure a lock member.

In the aforementioned embodiment, an example in which the urging member 5 constantly urges the supporting portion 19*b* of the lock member 4. However, the urging member 5 may be configured not to perform urging in the aforementioned "(1) a state in which the locking portion is present at the locking position at which the locking portion is completely locked with the flat conductor and in which the lock member is present at the close position at which the lock member is not rotatable". In this case, for example, it is possible to employ an arrangement in which the urging member 5 is in contact with the supporting portion 19*b* and in which an urging force due to elastic deformation, however does not act thereon or an arrangement in which the urging member 5 is not in contact with the supporting portion 19*b* and in which, when the lock member 4 is rotated, the supporting portion 19*b*, however, immediately comes into contact with the urging member 5.

REFERENCE SIGNS LIST

1 flat-conductor connector
2 flat conductor
2*a* front end portion
2*b* ground connection portion
2*c* side edge
2*d* locking piece
2*e* locking recess portion
2*f* locking edge
3 housing
4 lock member
5 urging member
5*a* fixed piece portion
5*b* elastic piece portion (spring piece)
5*c* bent portion (spring piece)
5*d* locking piece portion (spring piece)
5*e* locking edge
6 terminal
6*a* substrate connection portion
6*b* fixed base portion
6*c* reinforcing piece
6*d* front contact piece
6*d*1 front contact point
6*d*2 front elastic arm
6*e* rear contact piece
6*e*1 rear contact point
6*e*2 rear elastic arm
7 ground terminal
7*a* ground contact piece
7*b* coupling piece portion
8 upper wall portion
8*a* insertion hole
8*b* ground-contact-piece housing groove
8*c* placement face
8*d* abutting wall (rotation restriction portion)
9 bottom wall portion
9*a* contact-piece housing groove
9*b* opening
9*c* ground-terminal fixing groove
9*d* projection
10 side wall portion
10*a* front inner wall
10*b* outer wall
10*c* urging-member fixing portion
11 rear wall portion
11*a* groove
11*b* abutting wall (rotation restriction portion)
11*c* terminal fixing portion
12 housing chamber
12*a* insertion port
13 supporting recess portion
13*a* front wall
13*b* rear wall
14 movement restricting portion
14*a* upper abutting surface
14*b* lower abutting surface
15 urging-member housing portion
16 rotation support surface portion
17 body portion
17*a* flat surface portion
17*b* inclined portion (rotation restriction portion)
17*c* projecting portion
17*d* rotation guiding surface
17*e* slip-off stop locking surface (locking portion)
18 front wall portion
19 side wall portion
19*a* side wall
19*b* supporting portion
19*b*1 outer shaft portion
19*b*2 inner shaft portion

19*c* recessed portion
19*d* cam face
19*d*1 first locking surface (flat surface portion)
19*d*2 second locking surface
19*e* first rotation surface
19*f* second rotation surface
20 movement restricting portion
20*a* upper abutting surface
20*b* lower abutting surface
P substrate
X width direction, left-right direction
Y depth direction, front-rear direction
Z height direction, up-down direction

The invention claimed is:

1. A flat-conductor connector comprising:

a housing including a housing chamber into which and from which a flat conductor is insertable and extractable; and a lock member including a locking portion configured to pass through the flat conductor housed in the housing chamber in a thickness direction of the flat conductor and lock the flat conductor, wherein the lock member includes a supporting portion that supports the locking portion so as to be displaceable between a locking position and a lock cancellation position, the locking position being a position at which the lock member is locked with and stops the flat conductor from slipping off, the lock cancellation position being a position at which the lock member is unlocked from the flat conductor to cause the flat conductor to be extractable from the housing chamber, wherein the supporting portion has an outer shaft portion projecting from a side wall of the lock member, and wherein the flat-conductor connector comprises an urging member including a spring piece that urges an outer circumference surface of the outer shaft portion of the supporting portion so as to displace the locking portion present at the lock cancellation position to the locking position.

2. The flat-conductor connector according to claim 1, wherein the supporting portion supports the lock member at the housing so as to be rotatable and displaceable between a close position of the lock member at which the locking portion is present at the locking position and an open position of the lock member at which the locking portion is present at the lock cancellation position.

3. The flat-conductor connector according to claim 2, wherein the lock member and the housing each include a rotation restriction portion configured to abut, at the open position of the lock member, on the lock member and restrict rotational displacement in an opening direction.

4. The flat-conductor connector according to claim 1, wherein the supporting portion includes a cam face that changes a contact position thereof with respect to the urging member such that an urging force received from the spring piece of the urging member is larger when the locking portion is present at the lock cancellation position than when the locking portion is present at the locking position.

5. The flat-conductor connector according to claim 4, wherein the cam face includes a flat surface portion with which the urging member comes into surface contact when the locking portion is present at the locking position.

6. The flat-conductor connector according to claim 1, wherein the urging member is formed by a metal piece and disposed such that a plate surface of the metal piece is along a height direction of the housing chamber along the thickness direction of the flat conductor, and the urging member includes, at a plate edge along a thickness direction of the metal piece, a locking edge configured to be pressed to come into contact with the supporting portion.

7. The flat-conductor connector according to claim 1, wherein the lock member and the housing each include a movement restricting portion at which the lock member abuts, when the locking portion is present at the locking position, on the housing in an extracting direction of the flat conductor.

8. The flat-conductor connector according to claim 1, wherein the housing includes a supporting recess portion configured to house the supporting portion of the lock member.

* * * * *